US009347299B2

(12) United States Patent
Gisolf et al.

(10) Patent No.: US 9,347,299 B2
(45) Date of Patent: May 24, 2016

(54) PACKER TOOL INCLUDING MULTIPLE PORTS

(71) Applicant: Schlumberger Technology Corporation, Sugar Land, TX (US)

(72) Inventors: Adriaan Gisolf, Houston, TX (US); Nathan Landsiedel, Fresno, TX (US); Pierre-Yves Corre, Eu (FR); Ashers Partouche, Richmond, TX (US); Julian Pop, Houston, TX (US); Beatriz E. Barbosa, Houston, TX (US); Cosan Ayan, Istanbul (TR); George C. Tevis, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 61 days.

(21) Appl. No.: 14/136,935

(22) Filed: Dec. 20, 2013

(65) Prior Publication Data

US 2015/0176376 A1 Jun. 25, 2015

(51) Int. Cl.

| | |
|---|---|
| ***E21B 43/12*** | (2006.01) |
| ***E21B 33/124*** | (2006.01) |
| ***E21B 47/06*** | (2012.01) |

(52) U.S. Cl.

CPC ..... *E21B 43/12* (2013.01); *E21B 33/1243* (2013.01); *E21B 47/06* (2013.01)

(58) Field of Classification Search

CPC ... E21B 43/103; E21B 43/105; E21B 43/106; E21B 31/14; E21B 33/16; E21B 33/1243; E21B 23/06; E21B 33/124; E21B 33/12; E21B 21/10; E21B 49/10; E21B 33/127; E21B 49/081; E21B 33/128

See application file for complete search history.

(56) References Cited

U.S. PATENT DOCUMENTS

| | | | | |
|---|---|---|---|---|
| 2,747,401 | A | 5/1956 | Doll | |
| 3,181,608 | A * | 5/1965 | Palmer | E21B 47/10 166/187 |
| 4,320,800 | A * | 3/1982 | Upchurch | 166/106 |
| 4,353,249 | A | 10/1982 | Lagus et al. | |
| 4,742,459 | A | 5/1988 | Lasseter | |
| 4,860,581 | A | 8/1989 | Zimmerman et al. | |
| 4,936,139 | A | 6/1990 | Zimmerman et al. | |
| 5,247,830 | A | 9/1993 | Goode | |
| 5,269,180 | A | 12/1993 | Dave et al. | |
| 5,279,153 | A | 1/1994 | Dussan V. et al. | |

(Continued)

FOREIGN PATENT DOCUMENTS

| | | |
|---|---|---|
| WO | WO 2008100156 A1 * | 8/2008 |
| WO | 2009086279 A2 | 7/2009 |

OTHER PUBLICATIONS

U.S. Appl. No. 13/923,220, filed Jun. 20, 2013.

(Continued)

*Primary Examiner* — Zakiya W Bates
(74) *Attorney, Agent, or Firm* — Kenneth L. Kincaid

(57) ABSTRACT

A tool to be used within a wellbore including a wall, the wellbore extending through a formation including formation fluid, includes a first packer and a second packer. The first packer includes a packer port to enable formation fluid flow through the first packer, with the second packer spaced from the first packer. The first packer and the second packer are expandable to abut the wellbore wall to form an interval within the wellbore between the first packer and the second packer, in which the tool further includes an interval port in fluid communication with the interval.

20 Claims, 8 Drawing Sheets

(56) References Cited

U.S. PATENT DOCUMENTS

| | | | | |
|---|---|---|---|---|
| 5,353,637 | A | 10/1994 | Plumb et al. | |
| 5,361,836 | A * | 11/1994 | Sorem et al. | 166/187 |
| 5,517,584 | A | 5/1996 | Jennings | |
| 5,663,559 | A | 9/1997 | Auzerais et al. | |
| 5,799,733 | A * | 9/1998 | Ringgenberg et al. | 166/264 |
| 6,092,416 | A | 7/2000 | Halford et al. | |
| 6,675,892 | B2 | 1/2004 | Kuchuk et al. | |
| 7,277,796 | B2 | 10/2007 | Kuchuk et al. | |
| 7,445,043 | B2 | 11/2008 | Mullins et al. | |
| 7,647,980 | B2 | 1/2010 | Corre et al. | |
| 7,699,124 | B2 | 4/2010 | Corre et al. | |
| 7,913,557 | B2 | 3/2011 | Vasques et al. | |
| 7,944,211 | B2 | 5/2011 | Smits | |
| 8,078,403 | B2 | 12/2011 | Zhang et al. | |
| 8,091,634 | B2 | 1/2012 | Corre et al. | |
| 8,322,416 | B2 * | 12/2012 | Pop | E21B 33/1243 166/100 |
| 8,473,214 | B2 | 6/2013 | Gok et al. | |
| 2009/0183882 | A1 * | 7/2009 | van Zuilekom | E21B 49/081 166/371 |

OTHER PUBLICATIONS

U.S. Appl. No. 13/750,923, filed Jan. 25, 2013.

U.S. Appl. No. 13/658,395, filed Oct. 23, 2013.

Al-Otaibi et al. "Oil-Water Delineation with a New Formation Tester Module," SPE 159641, SPE Annual Technical Conference and Exhibition, Oct. 8-10, 2012, San Antonio, Texas, pp. 1-13.

Flores de Dios et al. "New Wireline Formation Tester Development Makes Sampling and Pressure Testing Possible in Extra-Heavy Oil in Mexico," SPE 159868, SPE Annual Technical Conference and Exhibition, Oct. 8-10, 2012, San Antonio, Texas, pp. 1-9.

* cited by examiner

PACKER TOOL INCLUDING MULTIPLE PORTS

BACKGROUND

A wellbore is generally drilled into the ground to recover natural deposits of hydrocarbons trapped in a geological formation below the Earth's crust. The wellbore is traditionally drilled to penetrate a subsurface hydrocarbon reservoir in the geological formation. As a result, the trapped hydrocarbons may be released and recovered from the wellbore.

A variety of packers are used in wellbores to isolate specific wellbore regions. A packer is delivered downhole on a conveyance and expanded against the surrounding wellbore wall to isolate a region of the wellbore. Often, two or more packers can be used to isolate one or more regions in a variety of well related applications, including production applications, service applications, and testing applications.

In some applications, packers are used to isolate regions for collection of formation fluids. For example, a straddle packer can be used to isolate a specific region of the wellbore to allow collection of fluids. A straddle packer uses a dual packer configuration in which fluids are collected between two separate packers. The dual packer configuration, however, may be susceptible, such as to mechanical stresses, that may limit the expansion ratio and the drawdown pressure differential that can be employed.

SUMMARY

In an embodiment, the present disclosure may relate to a tool to be used within a wellbore including a wall with the wellbore extending through a formation including formation fluid. The tool includes a first packer including a packer port to enable formation fluid flow through the first packer and a second packer spaced from the first packer, with the first packer and the second packer being expandable to abut the wellbore wall to form an interval within the wellbore between the first packer and the second packer. The tool further includes an interval port in fluid communication with the interval.

In another embodiment, the present disclosure may relate to a method of accessing formation fluid within a wellbore including a wall. The method includes forming an interval within the wellbore by expanding a first packer and a second packer of a tool to abut the wellbore wall, the tool including a packer port and an interval port, changing a state of one of the packer port and the interval port of the tool, and measuring a change in pressure of fluid flow received into the tool based upon the change of state of the one of the packer port and the interval port of the tool. The method further includes determining whether to change the state of the one of the packer port and the interval port of the tool based upon the measured change in pressure of fluid flow received in the tool.

In yet another embodiment, the present disclosure may relate to a system to access formation fluid within a wellbore including a wall, the wellbore extending through a formation including formation fluid. The system includes a first expandable packer including a packer port positioned upon the first expandable packer, the packer port in fluid communication with a flow path of the tool, a second expandable packer spaced from the first expandable packer, and a mandrel extending between the first expandable packer and the second expandable packer, the mandrel including an interval port in fluid communication with the flow path of the tool. The system further includes a valve operably coupled to the flow path to selectively enable fluid flow through one of the packer port and the interval port, a pressure gauge operably coupled to the flow path to measure pressure of fluid flow through one of the packer port and the interval port, and a controller to control an operation of the valve based on a measured pressure of fluid flow through one of the packer port and the interval port from the pressure gauge.

BRIEF DESCRIPTION OF THE DRAWINGS

For a detailed description of the embodiments of the invention, reference will now be made to the accompanying drawings in which.

DETAILED DESCRIPTION

Figure 1:
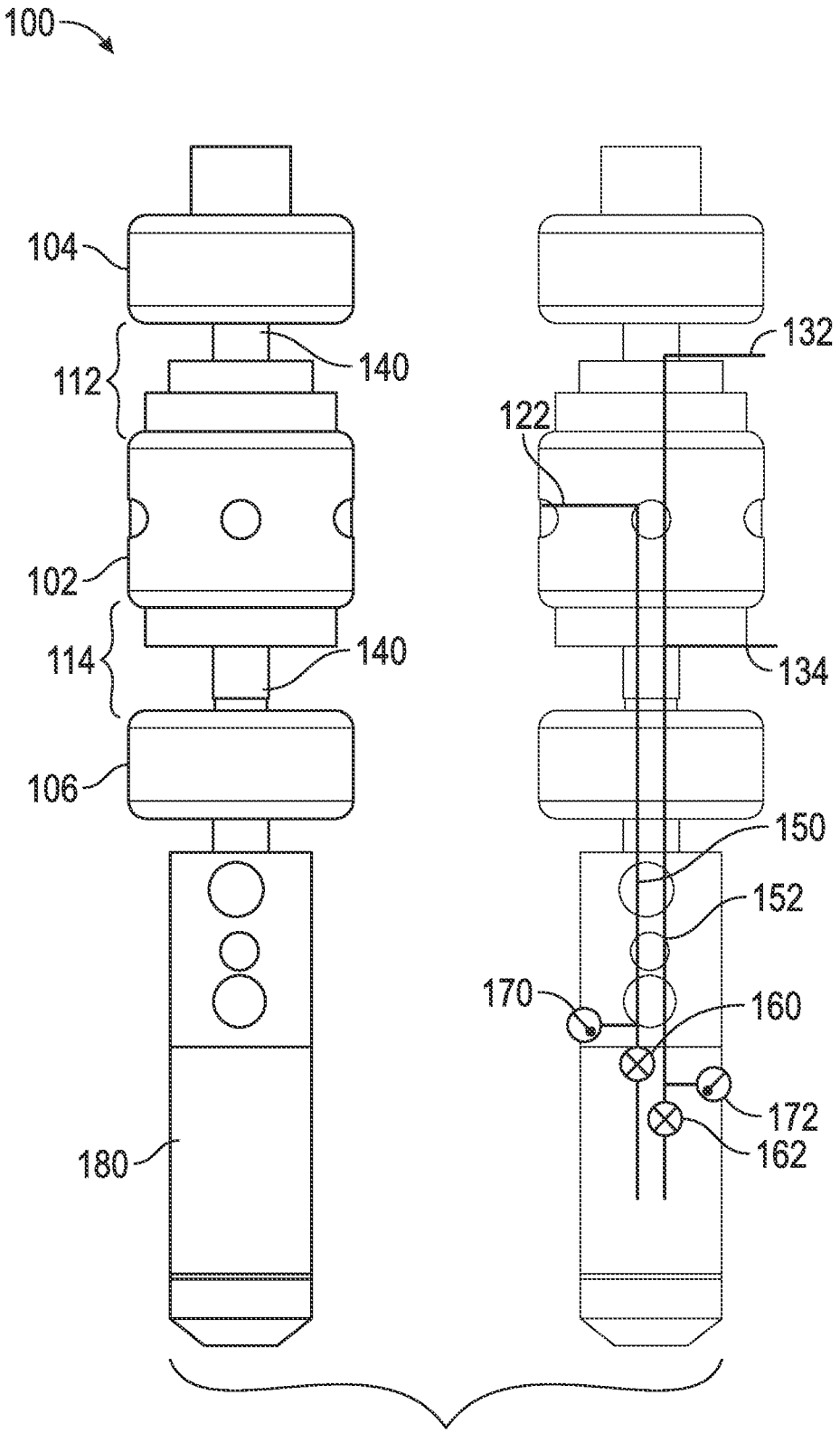
FIG. 1 shows multiple views of a tool in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Accordingly, disclosed herein is a tool for use within a wellbore, in addition to a method of accessing formation fluid within a wellbore. The tool includes a first packer with a packer port to enable fluid flow through the first packer and a second packer, in which the first packer and the second packer are expandable to abut a wellbore wall to form an interval within the wellbore. The tool then further includes an interval port in fluid communication with the interval. The tool may include a mandrel extending between the first packer and the second packer, in which the mandrel may include the interval port. Additional packers and ports may be included with the tool, such as ports included within additional packers of the tool and/or additional intervals formed by the tool. Further, one or more flow paths may be formed within the tool, one or more valves may be used to control fluid flow through the ports, and one or more pressures gauges and sensors may be used to measure properties and characteristics of the wellbore and fluid flowing through the tool.

Referring now to FIG. 1, multiple views of a tool 100 in accordance with one or more embodiments of the present disclosure are shown. In particular, FIG. 1 shows a side view and a fluid schematic view of the tool 100. The tool 100 may be used within a wellsite system, which may be located onshore or offshore, in which the present systems and methods for collecting one or more measurements, data, information and/or samples may be employed and/or practiced. For example, a wellbore or borehole (hereinafter "wellbore") may be drilled and/or formed within a subsurface, porous reservoir or formation (hereinafter "reservoir") by one or more known drilling techniques. The wellbore may be drilled into or formed within the reservoir to recover and/or collect deposits of hydrocarbons, water, gases, such as, for example, non-hydrocarbon gases and/or other desirable materials trapped within the reservoir. The wellbore may be drilled or formed to penetrate the reservoir that may contain the trapped hydrocarbons, and/or other desirable materials, such as, for example, gases, water, carbon dioxide, and/or the like. As a result, the trapped hydrocarbons and/or other desirable materials may be released from the reservoir and/or may be recovered or collected via the wellbore. Accordingly, the wellbore may extend through a formation including formation fluid to produce the formation fluid.

Embodiments of the present systems and methods may be utilized during and/or after one or more vertical, horizontal and/or directional drilling operations or combinations thereof. As a result, the wellbore may be a vertical wellbore, a horizontal wellbore, an inclined wellbore, or may have any combination of vertical, horizontal and inclined portions. The above-described wellsite system may be used as an example system in which the present disclosure may be incorporated and/or utilized, but a person having ordinary skill in the art will understand that the present disclosure may be utilized during and/or after any known drilling operation and/or downhole application, as known to one having ordinary skill in the art, such as, for example, logging, formation evaluation, drilling, sampling, reservoir testing, completions, flow assurance, production optimization, cementing and/or abandonment of the wellbore.

As shown, the tool 100 may include one or more packers, such as a first packer 102, a second packer 104, and a third packer 106. The packers 102, 104, and 106 may be expandable such that the packers 102, 104, and 106 may be used to abut and seal against a wall of a wellbore. For example, a packer in accordance with the present disclosure may include and/or be formed of a flexible and/or elastomeric material for squeezing, inflating, and/or otherwise expanding the packer. The packers 102, 104, and 106 may then be used to form one or more intervals in between the packers 102, 104, and 106, in which an interval may be defined as the annular space between adjacent packers within a wellbore. Accordingly, with respect to FIG. 1, the first packer 102 and the second packer 104 may be spaced from each other, such as axially spaced from each other, such that a first interval 112 is formed between the first packer 102 and the second packer 104 when expanded and abutting a wellbore well. Further, the first packer 102 and the third packer 106 may be spaced from each other such that a second interval 114 is formed between the first packer 102 and the third packer 106 when expanded and abutting a wellbore well.

The tool 100 may include one or more ports to enable fluid communication with the wellbore. As shown in FIG. 1, the first packer 102 may include a port 122 (e.g., a packer port) positioned therein and/or formed therethrough, in which the port 122 enables fluid flow between the tool 100 and the wellbore through the packer 102. For example, the first packer 102, in addition to other packers shown and discussed within the present disclosure, may include an expandable element, such as a rubber layer, an inflatable layer, a rubber layer, and/or other similar elements. The port 122 may be formed and/or positioned within the expandable element of the first packer 102, and/or the port 122 may be substantially surrounded by the expandable element. When the first packer 102 then expands to abut the wall of the wellbore, the port 122 may be positioned adjacent and/or partially embedded within the wall of the wellbore.

Further, the tool 100 may include one or more ports (e.g., interval ports) in fluid communication with the intervals formed between the packers of the tool 100. With respect to FIG. 1, a port 132 of the tool 100 may be in fluid communication with the first interval 112, and a port 134 of the tool 100 may be in fluid communication with the second interval 114. Accordingly, the ports 132 and/or 134 may enable fluid flow between the tool 100 and the wellbore through the first interval 112 and/or the second interval 114.

In the embodiment shown in FIG. 1, the tool 100 may include a mandrel 140, in which the mandrel 140 may extend through the tool 100. The mandrel 140 may extend between the first packer 102 and the second packer 104. In such an embodiment, the port 132 may be included within the mandrel 140, such as formed within the mandrel 140, to enable fluid flow between the tool 100 and the first interval 112 through the mandrel 140. To enable fluid communication with the interval 112, the port 132 may be positioned or formed on other surfaces of the tool 100 to enable fluid communication with the first interval 112, such as positioned on upper or lower surfaces or connection components of the first packer 102 or the second packer 104.

Similarly, the mandrel 140 may extend between the first packer 102 and the third packer 106. In such an embodiment, the port 134 may be included within the mandrel 140, such as formed within the mandrel 140, to enable fluid flow between the tool 100 and the second interval 114 through the mandrel 140. To enable fluid communication with the interval 114, the port 134 may be positioned or formed on other surfaces of the tool 100 to enable fluid communication with the second interval 114, such as positioned on upper or lower surfaces or connection components of the first packer 102 or the third packer 106. The mandrel 140 may also extend through the first packer 102, the second packer 104, and/or the third packer 106. Accordingly, the mandrel 140 may be formed as a single component or as multiple components coupled to each other.

A tool in accordance with one or more embodiments of the present disclosure may include one or more flow paths formed therein and/or extending therethrough. For example, with respect to FIG. 1, though a tool may only include one flow path in accordance with the present disclosure, the tool 100 may include a first flow path 150 and a second flow path 152. The first flow path 150 and/or the second flow path 152 may be formed within the mandrel 140 of the tool 100, and the first flow path 150 and/or the second flow path 152 may extend, at least partially, through the tool 100.

In one or more embodiments, one or more ports of the packers may be in fluid communication with one flow path, and one or more ports of the intervals between the packers may be in fluid communication with another flow path. For example, with reference to FIG. 1, the port 122 of the first packer 102 may be in fluid communication with the first flow path 150 (e.g., packer flow path), thereby enabling fluid to flow through the port 122 and into the first flow path 150. Further, the port 132 of the first interval 112 and/or the port 134 of the second interval 134 may be in fluid communication with the second flow path 152 (e.g., interval flow path), thereby enabling fluid to flow through the port 132 and/or the port 134 and into the second flow path 152.

A tool in accordance with the present disclosure may include one or more valves, one or more gauges, and/or one or more sensors. For example, with reference to FIG. 1, the tool 100 may include a first valve 160 and a second valve 162. The first valve 160 may be operably coupled to the first flow path 150, thereby allowing the first valve 160 to selectively enable fluid flow through the first flow path 150 and/or the port 122 in fluid communication with the first flow path 150. The second valve 162 may be operably coupled to the second flow path 152, thereby allowing the second valve 162 to selectively enable fluid flow through the second flow path 152, and/or the port 132 and/or the port 134 in fluid communication with the second flow path 152. A tool in accordance with the present disclosure may include a valve for each flow path, as shown in FIG. 1, may include a valve for each port, a combination of the two, and/or another arrangement for the valves.

Referring still to FIG. 1, the tool may include a first pressure gauge 170 and a second pressure gauge 172. The first pressure gauge 170 may be operably coupled to the first flow path 150, thereby allowing the first pressure gauge 170 to measure pressure of fluid and material flowing through the first flow path 150 and/or the port 122 in fluid communication with the first flow path 150. The second pressure gauge 172 may be operably coupled to the second flow path 152, thereby allowing the second pressure gauge 172 to measure pressure of fluid and material flowing through the second flow path 152, and/or the port 132 and/or the port 134 in fluid communication with the second flow path 152. A tool in accordance with the present disclosure may include a pressure gauge for each flow path, as shown in FIG. 1, may include a pressure gauge for each port, a combination of the two, and/or another arrangement for the pressure gauges.

A tool in accordance with the present disclosure, and/or one or more components of the tool, may be adapted and/or configured to collect one or more measurements, data and/or samples (hereinafter "measurements") associated with and/or based on one or more characteristics and/or properties relating to the wellbore and/or the reservoir (collectively known hereinafter as "characteristics of the reservoir"). Accordingly, a tool of the present disclosure may include one or more sensors to collect and measure one or more characteristics and/or properties relating to the wellbore and/or the reservoir. In such an embodiment, one or more sensors may be positioned on one or more of the packers of the tool, and/or may be positioned within one or more intervals of the tool. For example, a sensor may be positioned adjacent one or more of the ports of the tool, such as positioned adjacent each port of the tool to measure one or more characteristics of the reservoir.

Furthermore, the tool 100 may include one or more sondes. For example, as shown in FIG. 1, the tool 100 may include a sonde 180 positioned at an end thereof, such as coupled to an end of the mandrel 140. The sonde 180 may be a section of the tool 100 that may be used to contain one or more sensors, such as one or more sensors similar to that discussed above. In addition, the sonde 180 may be used to contain and/or house electronic components and/or power supply components.

A tool in accordance with the present disclosure, and/or one or more components thereof, may be and/or may include, for example, one or more downhole tools and/or devices that may be lowered and/or run into the wellbore. For example, the tool 100 may be a downhole formation testing tool that may be used to conduct, execute, and/or complete one or more downhole tests, such as, for example, a local production test, a buildup test, a drawdown test, an injection test, an interference test, and/or the like. The interference test may include, for example, an interval pressure transient test (hereinafter "IPTT test") and/or a vertical interference test. It should be understood that the one or more downhole tests that may be conducted by the tool 100 or components thereof may be any downhole tests as known to one of ordinary skill in the art.

A tool in accordance with the present disclosure, and/or one or more components thereof, may be conveyed into the wellbore by any known conveyance, such as drill pipe, tubular members, coiled tubing, wireline, slickline, cable, or any other type of conveyance. For example, in one or more embodiments, the tool 100 may be conveyed into the wellbore via a wireline cable. As a result, a tool of the present disclosure may be positionable and/or locatable within the wellbore and/or adjacent to one or more wellbore walls (hereinafter "walls") of the wellbore. In one or more embodiments, a tool of the present disclosure may be configurable to collect one or more measurements relating to the wellbore, the reservoir, and/or the walls of the wellbore. For example, the tool 100 may be used to collect pressure data and/or measurements relating to the wellbore and the reservoir. The tool 100 may be, for example, a formation testing tool configured to collect the pressure data and/or measurements relating to the wellbore and the reservoir. The tool 100 may be connected to and/or incorporated into, for example, a drill string, a test string, or a tool string.

In embodiments, a tool in accordance with the present disclosure, and/or one or more components thereof, may be connected to and/or incorporated into, for example, a modular formation dynamic tester (MDT™) test string. The drill string, test string, or tool string may include one or more additional downhole components (hereinafter "additional components"), such as, for example, drill pipe, one or more drill collars, a mud motor, a drill bit, a telemetry module, an additional downhole tool, and/or one or more downhole sensors. It should be understood that the drill string, test string, or tool string may include any number of and/or any type of additional downhole components as known to one of ordinary skill in the art.

Figure 2:
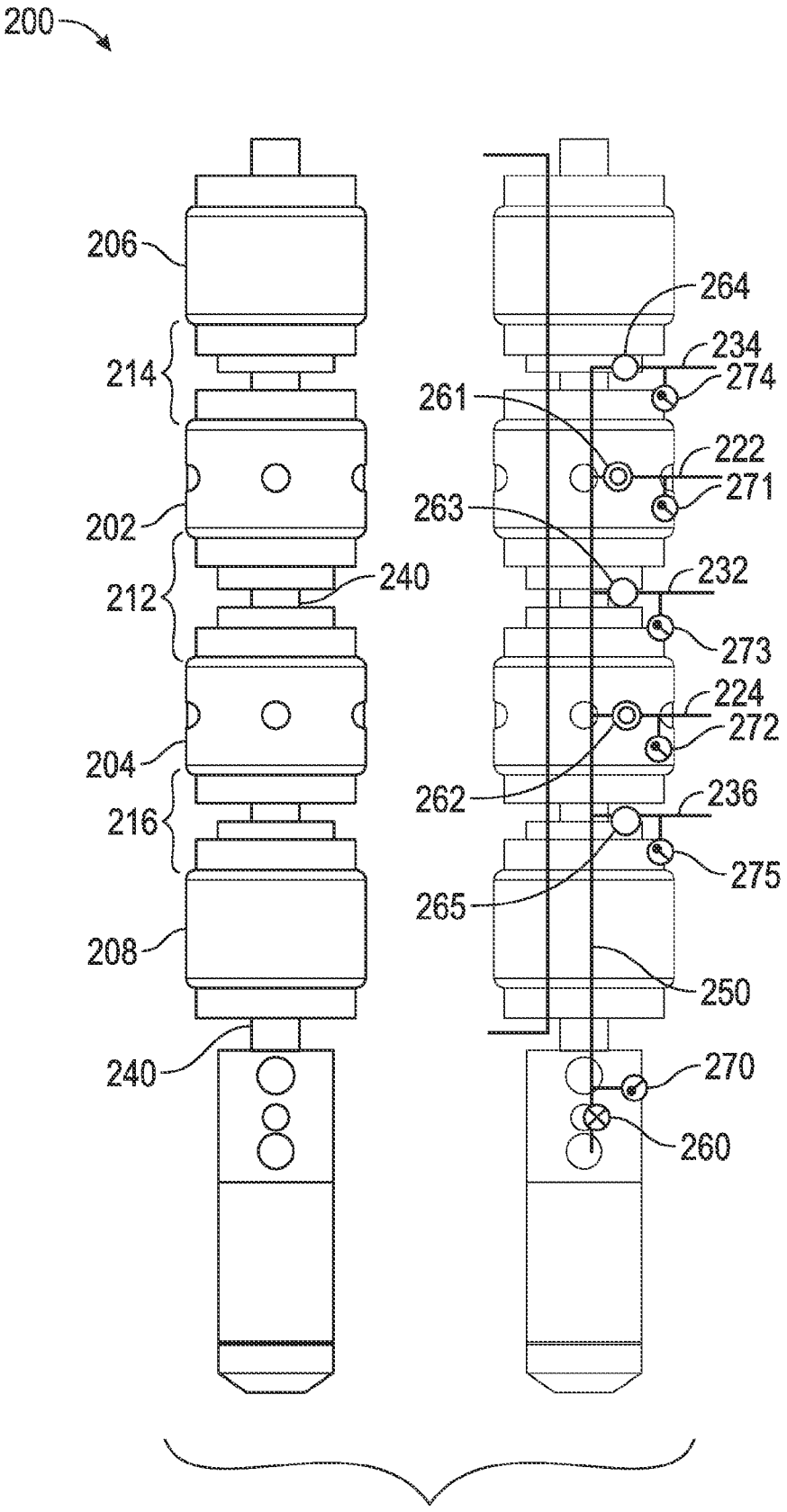
FIG. 2 shows multiple views of a tool in accordance with one or more embodiments of the present disclosure.

Referring now to FIG. 2, multiple views of a tool 200 in accordance with one or more embodiments of the present disclosure are shown. In particular, FIG. 2 shows a side view and a fluid schematic view of the tool 200. In this embodiment, the tool 200 may include a first packer 202, a second packer 204, a third packer 206, and a fourth packer 208, in which each of the packers 202, 204, 206, and 208 may be spaced apart from each other. Accordingly, a first interval 212 may be formed between the first packer 202 and the second packer 204, a second interval 214 may be formed between the first packer 202 and the third packer 206, and/or a third interval 216 may be formed between the second packer 204 and the fourth packer 208. In particular, one or more of the intervals 212, 214, and 216 may be formed when the packers 202, 204, 206, and 208 are expanded and abutting a wellbore well. Those having ordinary skill in the art will appreciate that, though a tool in accordance with the present disclosure is shown as having only four packers, a tool may also include more than four packers as well.

In this embodiment, the first packer 202 may include a port 222 positioned therein and/or formed therethrough, in which the port 222 enables fluid flow between the tool 200 and the wellbore through the first packer 202. Similarly, the second packer 204 may include a port 224 positioned therein and/or formed therethrough, in which the port 224 enables fluid flow between the tool 200 and the wellbore through the second packer 204.

Further, the tool 200 may include one or more ports in fluid communication with one or more of the intervals 212, 214, and 216 formed between the packers of the tool 200. With respect to FIG. 2, a port 232 of the tool 200 may be in fluid communication with the first interval 212, a port 234 of the tool 200 may be in fluid communication with the second interval 214, and/or a port 236 of the tool 200 may be in fluid communication with the third interval 216. In particular, in one or more embodiments, the tool 200 may include a mandrel 240, in which the mandrel 240 may extend through and/or between one or more components of the tool 200. In such an embodiment, one or more of the ports 232, 234, and 236 may be included within the mandrel 240 of the tool 200 to enable fluid flow through the mandrel 240. Accordingly, the ports 232, 234, and/or 236 may enable fluid flow between the tool 200 and the wellbore through the first interval 212, the second interval 214, and/or the third interval 216.

Referring still to FIG. 2, in this embodiment, the tool 200 may include a first flow path 250, in which one or more of the ports 222, 224, 232, 234, and 236 may be in fluid communication with the first flow path 250. Further, the tool 200 may include a first valve 260, a second valve 261, a third valve 262, a fourth valve 263, a fifth valve 264, and/or a sixth valve 265. The first valve 260 may be operably coupled to the first flow path 250, thereby selectively enabling fluid flow through the first flow path 250. The second valve 261 may be operably coupled to the port 222, thereby selectively enabling fluid flow through the port 222 of the first packer 202. The third valve 262 may be operably coupled to the port 224, thereby selectively enabling fluid flow through the port 224 of the second packer 204. The fourth valve 263 may be operably coupled to the port 232, thereby selectively enabling fluid flow through the port 232 of the first interval 212. The fifth valve 264 may be operably coupled to the port 234, thereby selectively enabling fluid flow through the port 234 of the second interval 214. The sixth valve 265 may be operably coupled to the port 236, thereby selectively enabling fluid flow through the port 236 of the third interval 216.

In accordance with one or more embodiments, one or more valves incorporated within a tool of the present disclosure may be selectively opened and closed, independent of each other. For example, with respect to FIG. 2, the second valve 261 of the first packer 202 and the third valve 262 of the second packer 204 may be closed, thereby preventing the flow of fluid through the ports 222 and 224 and into the first flow path 250. Further, the fourth valve 263 of the first interval 212, the fifth valve 264 of the second interval 214, and the sixth valve 265 of the third interval 216 may be opened, thereby allowing the flow of fluid through the ports 232, 234, and 236 into the first flow path 250. Accordingly, in such an embodiment, fluid may be selectively received into the tool 200 through the intervals 212, 214, and 216.

Further, as shown in FIG. 2, the tool 200 may include a pressure gauge associated with each of the valves of the tool 200. The tool 200 may include a first pressure gauge 270, a second pressure gauge 271, a third pressure gauge 272, a fourth pressure gauge 273, a fifth pressure gauge 274, and/or a sixth pressure gauge 275. The first pressure gauge 270 may be operably coupled to the first flow path 250, thereby allowing the first pressure gauge 270 to measure pressure of fluid and material flowing through the first flow path 250. The second pressure gauge 271 may be operably coupled to the port 222, thereby allowing the second pressure gauge 271 to measure pressure of fluid and material flowing through the port 222 of the first packer 202. The third pressure gauge 272 may be operably coupled to the port 224, thereby allowing the third pressure gauge 272 to measure pressure of fluid and material flowing through the port 224 of the second packer 204. The fourth pressure gauge 273 may be operably coupled to the port 232, thereby allowing the fourth pressure gauge 273 to measure pressure of fluid and material flowing through the port 232 of the first interval 212. The fifth pressure gauge 274 may be operably coupled to the port 234, thereby allowing the fifth pressure gauge 274 to measure pressure of fluid and material flowing through the port 234 of the second interval 214. The sixth pressure gauge 275 may be operably coupled to the port 236, thereby allowing the sixth pressure gauge 275 to measure pressure of fluid and material flowing through the port 236 of the third interval 216.

Figure 3:
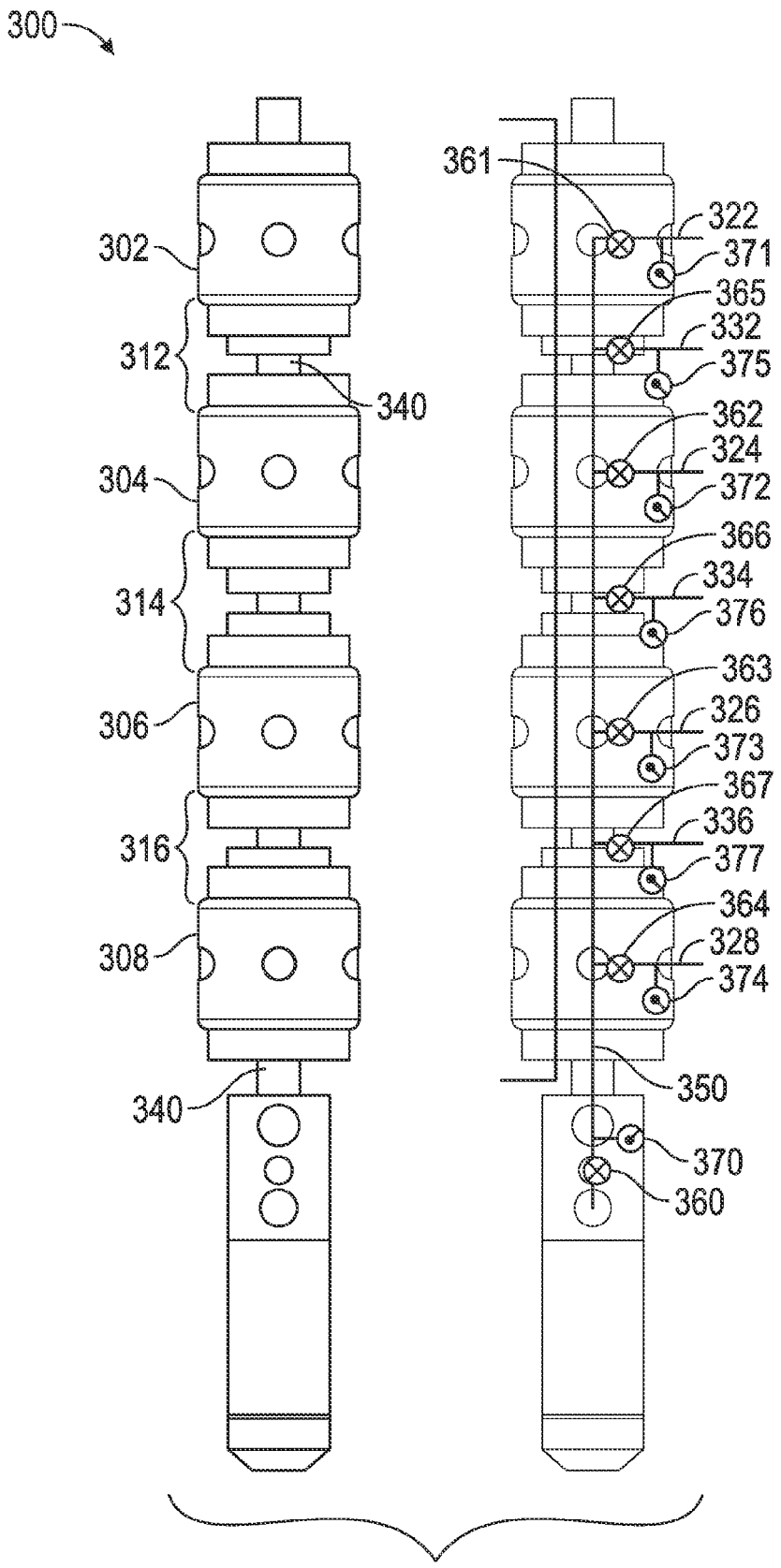
FIG. 3 shows multiple views of a tool in accordance with one or more embodiments of the present disclosure.
Figure 4:
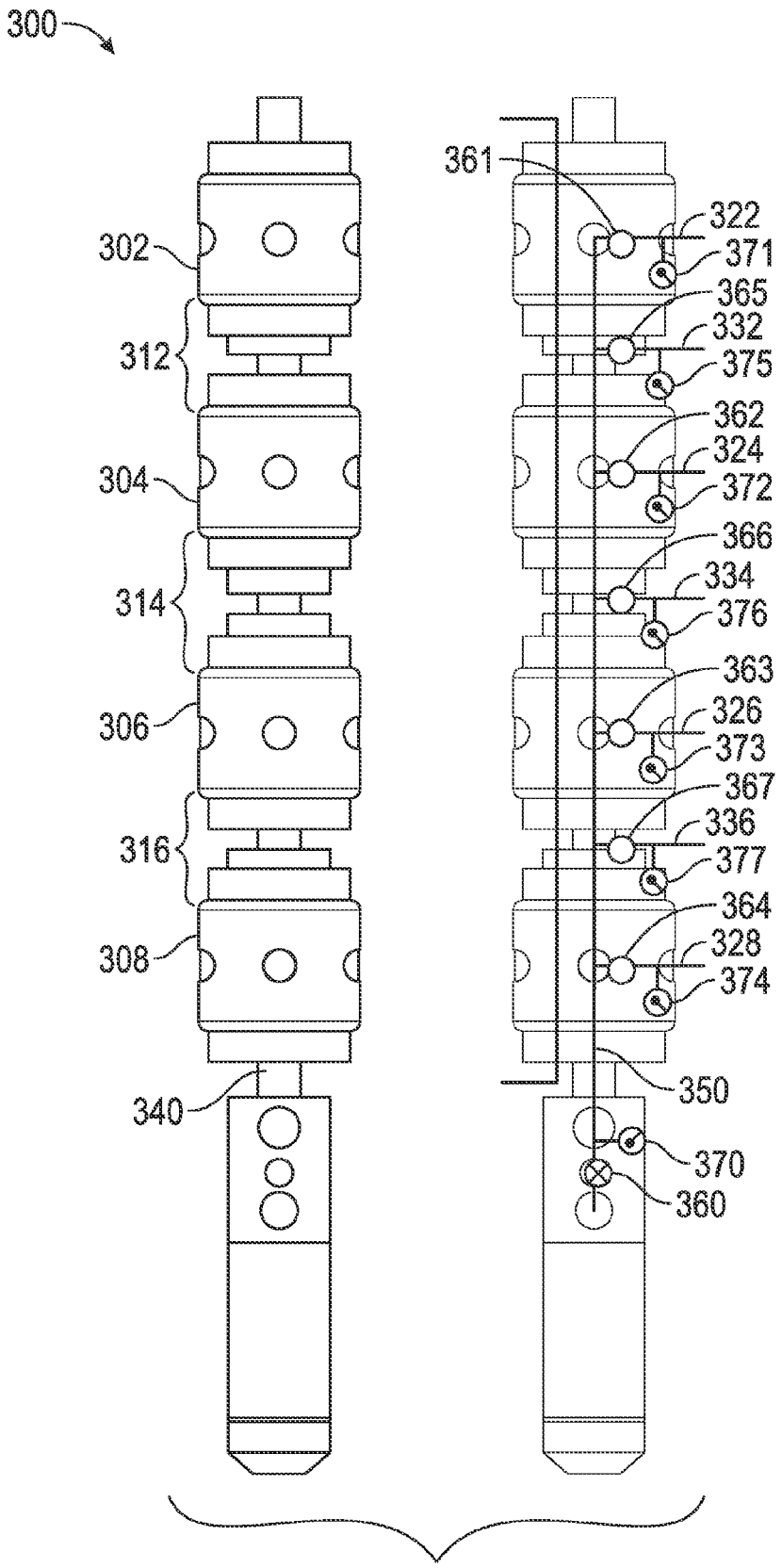
FIG. 4 shows multiple views of a tool in accordance with one or more embodiments of the present disclosure.
Figure 5:
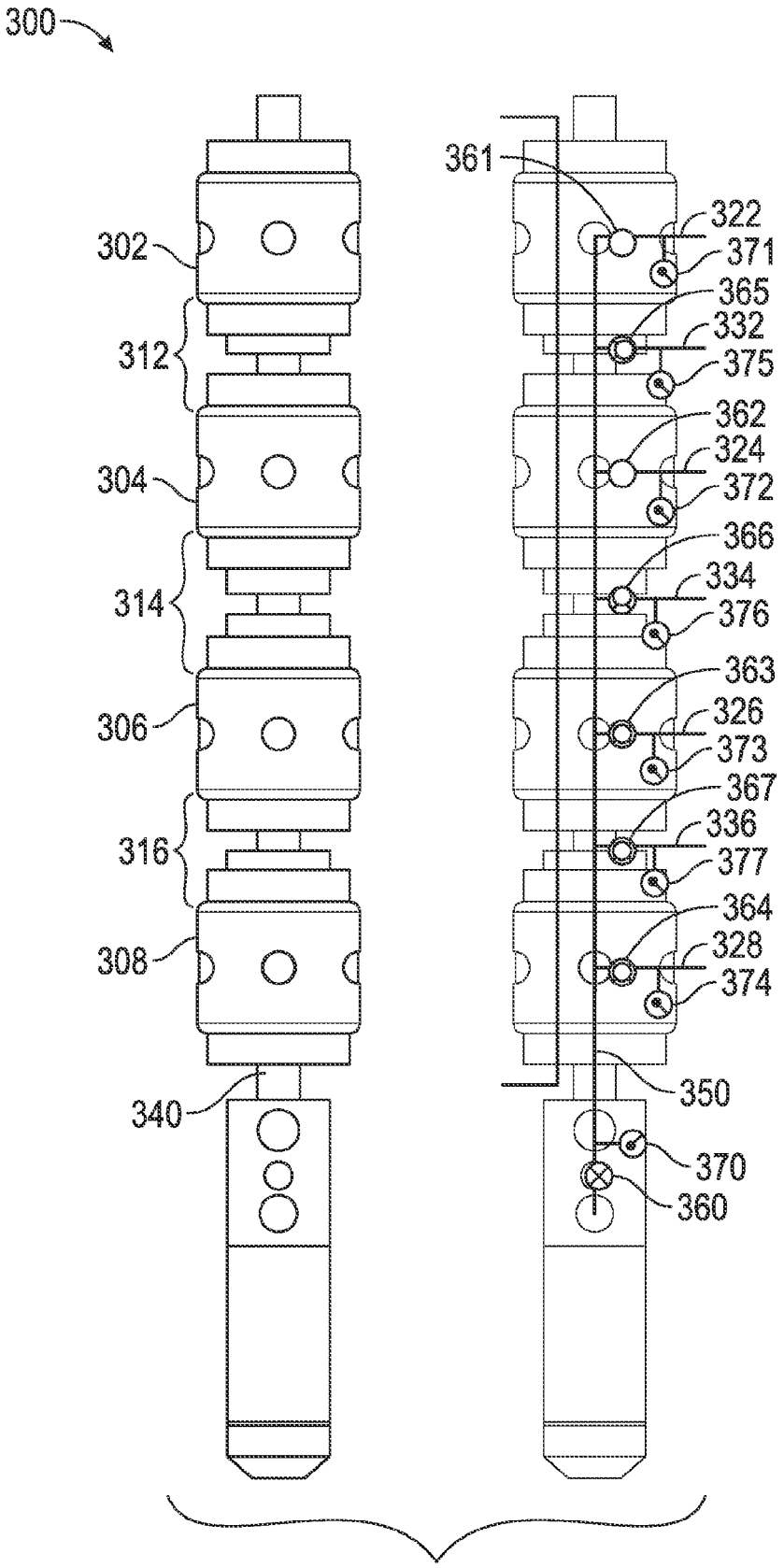
FIG. 5 shows multiple views of a tool in accordance with one or more embodiments of the present disclosure.

Referring now to FIGS. 3-5, multiple views of a tool 300 in accordance with one or more embodiments of the present disclosure are shown. In particular, FIGS. 3-5 show side views and fluid schematic views of the tool 300 including different internal flow configurations. In this embodiment, the tool 300 may include a first packer 302, a second packer 304, a third packer 306, and a fourth packer 308, in which each of the packers 302, 304, 306, and 308 may be spaced apart from each other. Further, a first interval 312 may be formed between the first packer 302 and the second packer 304, a second interval 314 may be formed between the second packer 304 and the third packer 306, and/or a third interval 316 may be formed between the third packer 306 and the fourth packer 308.

In this embodiment, the first packer 302 may include a port 322 positioned therein and/or formed therethrough, in which the port 322 enables fluid flow between the tool 300 and the wellbore through the first packer 302. The second packer 304 may include a port 324 positioned therein and/or formed therethrough, in which the port 324 enables fluid flow between the tool 300 and the wellbore through the second packer 304. The third packer 306 may include a port 326 positioned therein and/or formed therethrough, in which the port 326 enables fluid flow between the tool 300 and the wellbore through the third packer 306. Further, the fourth packer 308 may include a port 328 positioned therein and/or formed therethrough, in which the port 328 enables fluid flow between the tool 300 and the wellbore through the fourth packer 308.

Continuing with FIGS. 3-5, a port 332 of the tool 300 may be in fluid communication with the first interval 312, a port 334 of the tool 300 may be in fluid communication with the second interval 314, and/or a port 336 of the tool 300 may be in fluid communication with the third interval 316. In particular, in one or more embodiments, the tool 300 may include a mandrel 340, in which one or more of the ports 332, 334, and 336 may be included within the mandrel 340 of the tool 300 to enable fluid flow through the mandrel 340. Accordingly, the ports 332, 334, and/or 336 may enable fluid flow between the tool 300 and the wellbore through the first interval 312, the second interval 314, and/or the third interval 316. Thus, a tool in accordance with the present disclosure may include two or more packers, in which at least one of the packers may include a port and an interval in between the packers may include a port in fluid communication therewith. The tool 300 may also include a first flow path 350, in which one or more of the ports 322, 324, 326, 328, 332, 334, and 336 may be in fluid communication with the first flow path 350.

Further, the tool 300 may include a first valve 360, a second valve 361, a third valve 362, a fourth valve 363, a fifth valve 364, a sixth valve 365, a seventh valve 366, and/or an eighth valve 367. The first valve 360 may be operably coupled to the first flow path 350, thereby selectively enabling fluid flow through the first flow path 350. The second valve 361 may be operably coupled to the port 322, thereby selectively enabling fluid flow through the port 322 of the first packer 302. The third valve 362 may be operably coupled to the port 324, thereby selectively enabling fluid flow through the port 324 of the second packer 304. The fourth valve 363 may be operably coupled to the port 326, thereby selectively enabling fluid flow through the port 326 of the third packer 306. The fifth valve 364 may be operably coupled to the port 328, thereby selectively enabling fluid flow through the port 328 of the fourth packer 308. The sixth valve 365 may be operably coupled to the port 332, thereby selectively enabling fluid flow through the port 332 of the first interval 312. The seventh valve 366 may be operably coupled to the port 334, thereby selectively enabling fluid flow through the port 334 of the second interval 314. The eighth valve 367 may be operably coupled to the port 336, thereby selectively enabling fluid flow through the port 336 of the third interval 316.

As mentioned above, one or more valves incorporated within a tool of the present disclosure may be selectively opened and closed, independent of each other. For example, with respect to FIG. 4, each of the valves 360, 361, 362, 363, 364, 365, 366, and 367 may be opened, thereby allowing the flow of fluid through the ports 322, 324, 326, 328, 332, 334, and 336 into the first flow path 350. Further, one or more of the valves may be closed. For example, with respect to FIG. 5, the valve 362 may be closed, thereby preventing the flow of fluid through the port 324 into the first flow path 350. Further, the remainder of the valves 360, 361, 363, 364, 365, 366, and 367 may be opened, thereby allowing the flow of fluid through the ports 322, 326, 328, 332, 334, and 336 into the first flow path 350. Such an arrangement may enable a tool of the present disclosure to selectively draw fluid from certain portions from the wellbore, as desired. For example, in the embodiment shown in FIG. 5, if contaminant is flowing through the port 324, such as by indicated by a sensor coupled to the port 324 and/or the second packer 304, the valve 362 may be closed to prevent fluid from being drawn through the port 324.

Further, as shown in FIGS. 3-5, the tool 300 may include a pressure gauge associated with each of the valves of the tool 300. The tool 300 may include a first pressure gauge 370, a second pressure gauge 371, a third pressure gauge 372, a fourth pressure gauge 373, a fifth pressure gauge 374, a sixth pressure gauge 375, a seventh pressure gauge 376, and/or an eighth pressure gauge 377. The first pressure gauge 370 may be operably coupled to the first flow path 350, thereby allowing the first pressure gauge 370 to measure pressure of fluid and material flowing through the first flow path 350. The second pressure gauge 371 may be operably coupled to the port 322, thereby allowing the second pressure gauge 371 to measure pressure of fluid and material flowing through the port 322 of the first packer 302. The third pressure gauge 372 may be operably coupled to the port 324, thereby allowing the third pressure gauge 372 to measure pressure of fluid and material flowing through the port 324 of the second packer 304. The fourth pressure gauge 373 may be operably coupled to the port 326, thereby allowing the fourth pressure gauge 373 to measure pressure of fluid and material flowing through the port 326 of the third packer 306. The fifth pressure gauge 374 may be operably coupled to the port 328, thereby allowing the fifth pressure gauge 374 to measure pressure of fluid and material flowing through the port 328 of the fourth packer 306. The sixth pressure gauge 375 may be operably coupled to the port 332, thereby allowing the sixth pressure gauge 375 to measure pressure of fluid and material flowing through the port 332 of the first interval 312. The seventh pressure gauge 376 may be operably coupled to the port 334, thereby allowing the seventh pressure gauge 376 to measure pressure of fluid and material flowing through the port 334 of the second interval 314. The eighth pressure gauge 377 may be operably coupled to the port 336, thereby allowing the eighth pressure gauge 377 to measure pressure of fluid and material flowing through the port 336 of the third interval 316.

Figure 6:
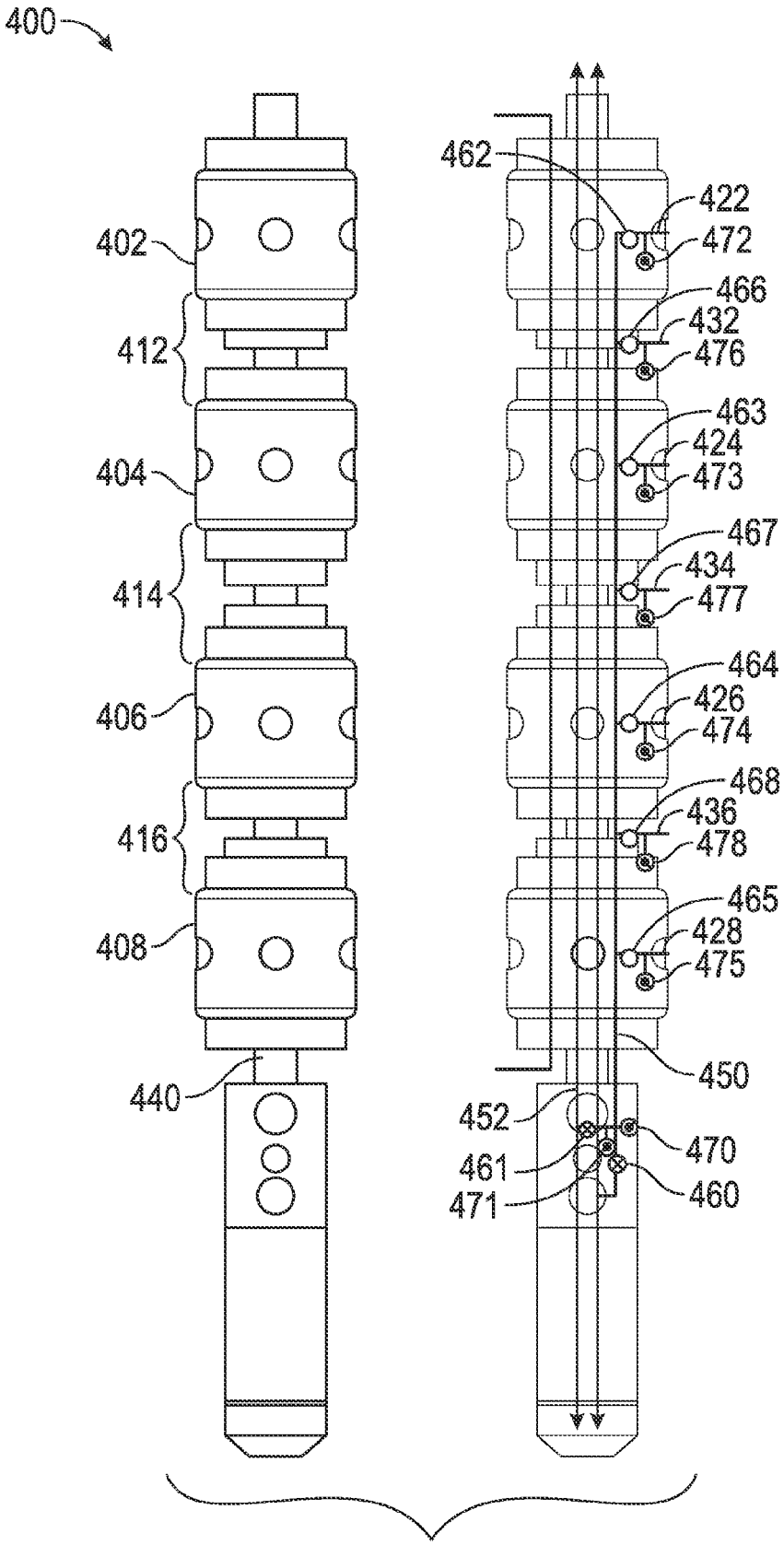
FIG. 6 shows multiple views of a tool in accordance with one or more embodiments of the present disclosure.
Figure 7:
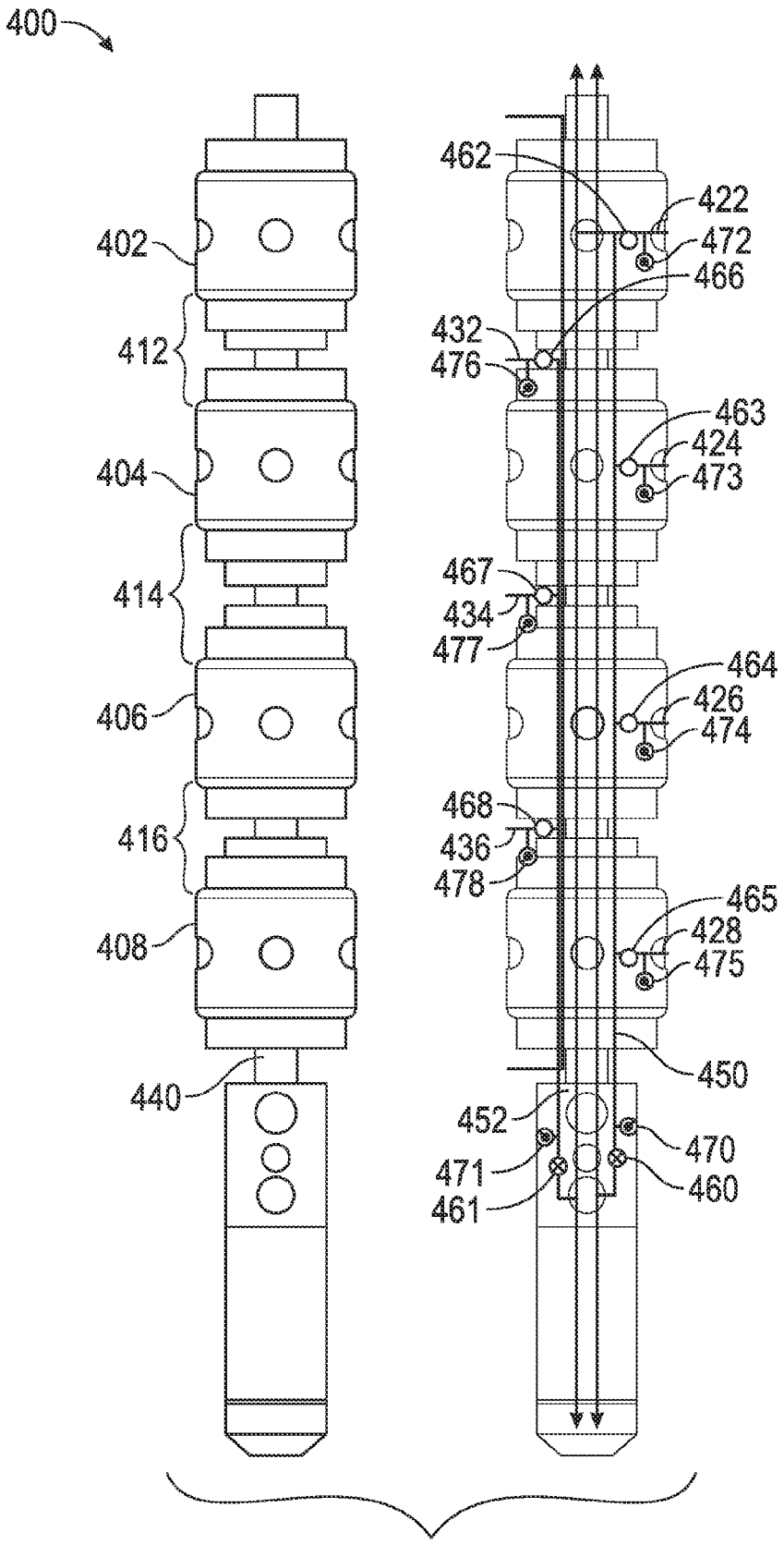
FIG. 7 shows multiple views of a tool in accordance with one or more embodiments of the present disclosure.

Referring now to FIGS. 6 and 7, multiple views of a tool 400 in accordance with one or more embodiments of the present disclosure are shown. In particular, FIGS. 6 and 7 show side views and fluid schematic views of the tool 400 including different internal flow configurations. In this embodiment, the tool 400 may include a first packer 402, a second packer 404, a third packer 406, and a fourth packer 408, in which each of the packers 402, 404, 406, and 408 may be spaced apart from each other. Further, a first interval 412 may be formed between the first packer 402 and the second packer 404, a second interval 414 may be formed between the second packer 404 and the third packer 406, and/or a third interval 416 may be formed between the third packer 406 and the fourth packer 408.

In this embodiment, each packer may include at least one port associated with the packer. Accordingly, the first packer 402 may include a port 422 positioned therein and/or formed therethrough, in which the port 422 enables fluid flow between the tool 400 and the wellbore through the first packer 402. The second packer 404 may include a port 424 positioned therein and/or formed therethrough, in which the port 424 enables fluid flow between the tool 400 and the wellbore through the second packer 404. The third packer 406 may include a port 426 positioned therein and/or formed therethrough, in which the port 426 enables fluid flow between the tool 400 and the wellbore through the third packer 406. Further, the fourth packer 408 may include a port 428 positioned therein and/or formed therethrough, in which the port 428 enables fluid flow between the tool 400 and the wellbore through the fourth packer 408.

Continuing with FIGS. 6 and 7, a port 432 of the tool 400 may be in fluid communication with the first interval 412, a port 434 of the tool 400 may be in fluid communication with the second interval 414, and/or a port 436 of the tool 400 may be in fluid communication with the third interval 416. In particular, in one or more embodiments, the tool 400 may include a mandrel 440, in which one or more of the ports 432, 434, and 436 may be included within the mandrel 440 of the tool 400 to enable fluid flow through the mandrel 440. Accordingly, the ports 432, 434, and/or 436 may enable fluid flow between the tool 400 and the wellbore through the first interval 412, the second interval 414, and/or the third interval 416.

As discussed above, a tool in accordance with the present disclosure may include one or more flow paths. In FIGS. 6 and 7, the tool 400 may each include a first flow path 450 and a second flow path 452. As shown, the flow paths 450 and 452 may be in fluid communication with each other such that fluid flowing through one of the flow paths 450 and 452 may be communicated to flow through the other of the flow paths 450 and 452. As shown in FIG. 1, the flow paths 150 and 152 may also be fluidly isolated from each other such that fluid flow is prevented from being communicated between the flow paths 150 and 152.

In FIG. 6, each of the ports 422, 424, 426, 428, 432, 434, and 436 may be in fluid communication with the first flow path 450, with the first flow path 450 in fluid communication with the second flow path 452. In FIG. 7, the ports 422, 424, 426, and 428 of the packers 402, 404, 406, and 408 may be in fluid communication with the first flow path 450 and the ports 432, 434, and 436 of the intervals 412, 414, and 416 may be in fluid communication with the second flow path 452, with the first flow path 450 in fluid communication with the second flow path 452. Accordingly, the present disclosure contemplates multiple arrangements for the ports and flow paths of the tool without departing from the scope of the present disclosure.

Further, the tool 400 may include a first valve 460, a second valve 461, a third valve 462, a fourth valve 463, a fifth valve 464, a sixth valve 465, a seventh valve 466, an eighth valve 467, and/or a ninth valve 468. The first valve 460 may be operably coupled to the first flow path 450, thereby selectively enabling fluid flow through the first flow path 450. The second valve 461 may be operably coupled to the first flow path 450, thereby selectively enabling fluid flow through the second flow path 452. The third valve 462 may be operably coupled to the port 422, thereby selectively enabling fluid flow through the port 422 of the first packer 402. The fourth valve 463 may be operably coupled to the port 424, thereby selectively enabling fluid flow through the port 424 of the second packer 404. The fifth valve 464 may be operably coupled to the port 426, thereby selectively enabling fluid flow through the port 426 of the third packer 406. The sixth valve 465 may be operably coupled to the port 428, thereby selectively enabling fluid flow through the port 428 of the fourth packer 408. The seventh valve 466 may be operably coupled to the port 432, thereby selectively enabling fluid flow through the port 432 of the first interval 412. The eighth valve 467 may be operably coupled to the port 434, thereby selectively enabling fluid flow through the port 434 of the second interval 414. The ninth valve 468 may be operably coupled to the port 436, thereby selectively enabling fluid flow through the port 436 of the third interval 416.

Further, as shown in FIGS. 6 and 7, the tool 400 may include a pressure gauge associated with each of the valves of the tool 400. The tool 400 may include a first pressure gauge 470, a second pressure gauge 471, a third pressure gauge 472, a fourth pressure gauge 473, a fifth pressure gauge 474, a sixth pressure gauge 475, a seventh pressure gauge 476, an eighth pressure gauge 477, and/or a ninth pressure gauge 478. The first pressure gauge 470 may be operably coupled to the first flow path 450, thereby allowing the first pressure gauge 470 to measure pressure of fluid and material flowing through the first flow path 450. The second pressure gauge 471 may be operably coupled to the second flow path 452, thereby allowing the second pressure gauge 471 to measure pressure of fluid and material flowing through the second flow path 451. The third pressure gauge 472 may be operably coupled to the port 422, thereby allowing the third pressure gauge 472 to measure pressure of fluid and material flowing through the port 422 of the first packer 402. The fourth pressure gauge 473 may be operably coupled to the port 424, thereby allowing the fourth pressure gauge 473 to measure pressure of fluid and material flowing through the port 424 of the second packer 404. The fifth pressure gauge 474 may be operably coupled to the port 426, thereby allowing the fifth pressure gauge 474 to measure pressure of fluid and material flowing through the port 426 of the third packer 406. The sixth pressure gauge 475 may be operably coupled to the port 428, thereby allowing the sixth pressure gauge 475 to measure pressure of fluid and material flowing through the port 428 of the fourth packer 406. The seventh pressure gauge 476 may be operably coupled to the port 432, thereby allowing the seventh pressure gauge 476 to measure pressure of fluid and material flowing through the port 432 of the first interval 412. The eighth pressure gauge 477 may be operably coupled to the port 434, thereby allowing the eighth pressure gauge 477 to measure pressure of fluid and material flowing through the port 434 of the second interval 414. The ninth pressure gauge 478 may be operably coupled to the port 436, thereby allowing the ninth pressure gauge 478 to measure pressure of fluid and material flowing through the port 436 of the third interval 416.

Figure 8:
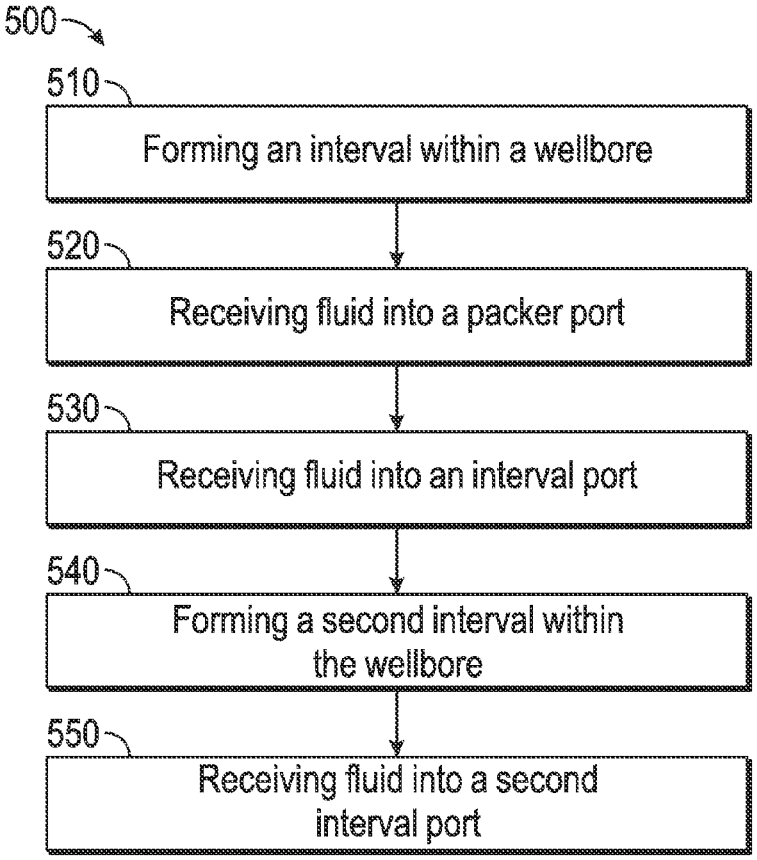
FIG. 8 shows a flow chart of a method in accordance with one or more embodiments of the present disclosure.

Referring now to FIG. 8, a flow chart of a method 500 of accessing formation fluid within a wellbore including a wall in accordance with one or more embodiments of the present disclosure is shown. The method 500 may include forming an interval within a wellbore 510, such as by expanding a first packer and expanding a second packer to abut the wellbore wall. For example, with respect to the tool 400 shown in FIG. 7, the first packer 402 may be expanded to abut a wall of the wellbore, and the second packer 404 may be expanded to also abut the wall of the wellbore. Expanding the first packer 510 and expanding the second packer 520 may then form an interval within the wellbore between the first packer and the second packer. For example, in FIG. 7, a first interval 412 is formed between the first packer 402 and the second packer 404 when expanded.

The method 500 may further include receiving fluid into a packer port 520 and/or receiving fluid into an interval port 530. For example, continuing with FIG. 7, the port 422 positioned on the first packer 402 may be used to receive formation fluid flow therethrough, and the port 432 in fluid communication with the first interval 412 may be used to receive formation fluid flow therethrough.

In an embodiment in which additional packers and/or ports are included with a tool of the present disclosure, the method 500 may further include forming a second interval within the wellbore 540, such as by expanding a third packer, and receiving fluid into a second interval port 550. For example, with reference to FIG. 7, the third packer 406 may be expanded to abut the wall of the wellbore, thereby forming a second interval 414 between the second packer 404 and the third packer 406. Fluid may then be received through the port 434 in fluid communication with the second interval 414. The port 424 of the second packer 404 may be used to receive fluid therethrough and/or the port 426 of the third packer 406 may be used to receive fluid therethrough. Such embodiments may enable fluid to be received within a tool in accordance with the present disclosure for sampling, testing, and/or other purposes, in which fluid may be received into within the tool from selective portions of the wellbore in the intervals between the packers and also adjacent the packers.

A tool in accordance with the present disclosure may have increased compressive strength. For example, a wellbore may have a zone-of-interest, in which the tool may be lowered into the wellbore to test the zone-of-interest. In such an embodiment, the tool may be positioned within the wellbore such that the packers and the intervals formed between the packers may positioned within the zone-of-interest. Fluid may then be pumped from the reservoir towards the wellbore to be received within one or more ports of the tool, thereby creating a compressive force upon the tool. However, by including packers with ports, the packers may be able to support the tool against the wellbore while also receiving fluid in through the ports of the packers, thereby creating additional compressive strength for the tool.

A tool in accordance with the present disclosure may enable one or more intervals and/or portions of a wellbore to be sampled from and/or tested, as desired. As discussed above, each of the ports of the tool, such as ports included within packers and/or ports in fluid communication with the intervals between the packers, may be opened and closed to selectively enable fluid flow therethrough. For example, a particular port, or a particular combination of ports, may be selectively closed. Pressure of the fluid flowing into the tool may then be measured, such as by using one or more of the pressure gauges discussed above, to determine if any change of pressure has resulted from the port(s) being selectively closed. If the no pressure change is observed, then the ports may not be contributing to the overall flow of fluid into and/or out of the tool. If a pressure change is observed, such as an overall decrease of pressure into the tool, then the ports may be contributing to the overall flow of fluid into and/or out of the tool.

Figure 9:
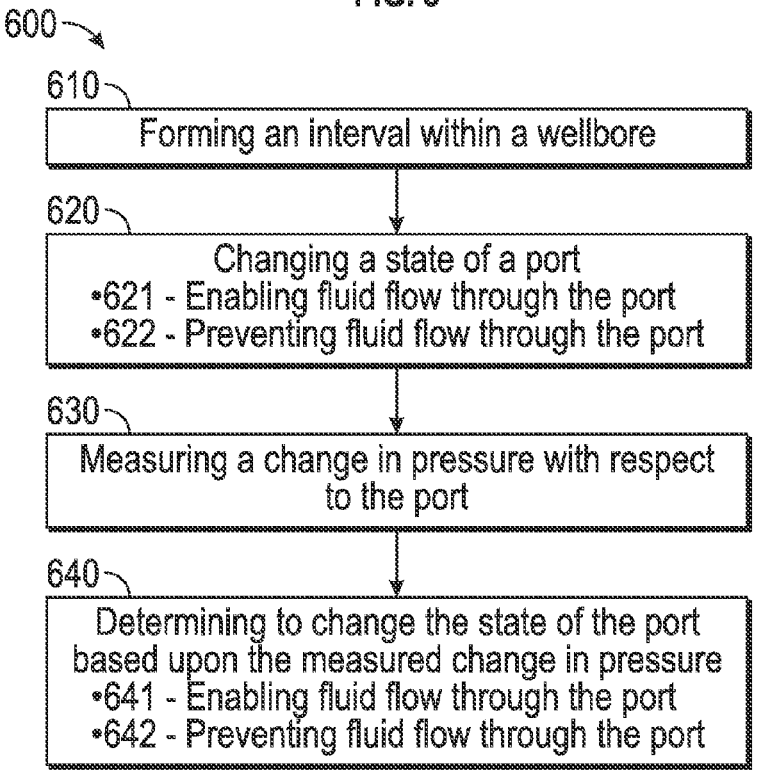
FIG. 9 shows a flow chart of a method in accordance with one or more embodiments of the present disclosure.

Referring now to FIG. 9, a flow chart of a method 600 of accessing formation fluid within a wellbore including a wall in accordance with one or more embodiments of the present disclosure is shown. The method 600 may include forming an interval within a wellbore 610, such as by expanding a first packer and expanding a second packer to abut the wellbore wall. The method 600 may further include changing a state of a port 620. In one embodiment, changing the state of a port 620 may include enabling fluid flow through the port 621 and/or may include preventing fluid flow through the port 622. For example, with respect to FIG. 7, the port 422 positioned on the first packer 402 may have a change in state, in which the valve 462 operably coupled to the port 422 and/or the valve 460 operably coupled to the flow path 450 may be opened if initially closed, thereby enabling fluid flow through the port 422, or the valve 462 and/or the valve 460 may be closed if initially opened, thereby preventing fluid flow through the port 422.

The method 600 may then further include measuring a change in pressure with respect to the port 630. For example, continuing with FIG. 7, the pressure gauge 472 operably coupled to the port 422 and/or the pressure gauge 470 operably coupled to the flow path 450 may be used to measure pressure of fluid flow received into the tool 400 through the port 422. Accordingly, the pressure gauge 472 and/or the pressure gauge 470 may be used to measure the change in pressure of fluid flow received into the tool before the change in state of the port and after the change in state of the port.

Based upon the measured change in pressure, the method 600 may further include determining to change the state of the port 640. Determining to change the state of the port based upon the measured change in pressure 640 may include enabling fluid flow through the port 641 and/or preventing fluid flow through the port 642. In one embodiment, if, based upon the measured change in pressure, it is determined that fluid flow through the port substantially contributes to the overall fluid flow into the tool, then the port may enable fluid flow therethrough and into the tool, such as by selectively opening one or more valves within the tool. If, based upon the measured change in pressure, it is determined that fluid flow through the port is negligible to the overall fluid flow into the tool, then the port may prevent fluid flow therethrough and into the tool, such as by selectively closing one or more valves within the tool.

For example, with respect to FIG. 7, in one embodiment, if the initial state of the port 422 is to prevent fluid flow therethrough, and then the state of the port 422 changes to enable fluid flow therethrough, the measured change in pressure of fluid flow into the tool 400 from enabling fluid flow through the port 422 may be compared to a predetermined amount. If the measured change in pressure of fluid flow received in the tool 400 is at or above the predetermined amount, then the port 422, and/or the wellbore or reservoir adjacent the port 422, may be determined as contributing to the overall fluid flow into the tool 400, in which the tool 400 may continue to enable fluid flow through the port 422 and into the tool 400. If the measured change in pressure of fluid flow received in the tool 400 is below the predetermined amount, then the port 422, and/or the wellbore or reservoir adjacent the port 422, may be determined as negligible and not significantly contributing to the overall fluid flow into the tool 400, in which the tool 400 may prevent fluid flow through the port 422 and into the tool 400.

In another embodiment, if the initial state of the port 422 is to enable fluid flow therethrough, and then the state of the port 422 changes to prevent fluid flow therethrough, the measured change in pressure of fluid flow into the tool 400 from preventing fluid flow through the port 422 may be compared to the predetermined amount. If the measured change in pressure, such as a magnitude of the measured change in pressure, of fluid flow received in the tool 400 is at or above the predetermined amount, then the port 422, and/or the wellbore or reservoir adjacent the port 422, may be determined as contributing to the overall fluid flow into the tool 400, in which the tool 400 may enable fluid flow through the port 422 and into the tool 400. If the measured change in pressure of fluid flow received in the tool 400 is below the predetermined amount, then the port 422, and/or the wellbore or reservoir adjacent the port 422, may be determined as negligible and not significantly contributing to the overall fluid flow into the tool 400, in which the tool 400 may continue to prevent fluid flow through the port 422 and into the tool 400.

Thought the present disclosure discusses the above method with respect to the port 422, a packer port, those having ordinary skill in the art will appreciate that an interval port may also be used in accordance with the present disclosure. Further, a tool, a system, and a method in accordance with the present disclosure may include changing a state of multiple ports at a time, in addition to single ports. For example, in one embodiment, some, if not all, of the packer ports of the tool may have a change of state to determine if the packer ports contribute to the overall fluid flow into the tool, and/or some, if not all, of the interval ports of the tool may have a change of state to determine if the interval ports contribute to the overall fluid flow into the tool. Further, selected ports, such as a selected portion, a selected end, and/or a selected distance of ports across the tool may have a change of state to determine if the selected ports, and therefore the wellbore and/or the reservoir adjacent the ports, contribute to the overall fluid flow into the tool.

A tool, a system, and/or a method in accordance with the present disclosure may include a controller, such as to control an operation of one or more valves within the tool. The controller may be operably coupled to one or more valves, such as to selectively open and close the valves, and the controller may be operably coupled to one or more pressure gauges, such as to receive measurements of pressures through the ports to which the pressure gauges are operably coupled. Accordingly, the controller may receive and compare the pressure measurements performed by the pressure gauges, such as before and after the ports have a change in state. The controller may then selectively open and close one or more valves based upon the changes in pressure. In particular, the controller may determine if a port is contributing to the overall fluid flow into the tool, in which the controller may close one or more valves to prevent fluid flow through the port if the controller determines the port does not contribute to the overall fluid flow, and/or the controller may open one or more valves to enable fluid flow through the port if the controller determines the port does contribute to the overall fluid flow.

Further, a tool, a system, and a method in accordance with the present disclosure may enable focused sampling. As the ports may be in fluid communication with multiple flow paths, fluid may be received through one or more ports to receive filtrate therein, whereas fluid may be received through other ports to receive sample fluid. For example, a port may be used on a packer to receive sample fluid therein, in which adjacent ports, such as ports of the intervals and/or ports of the packers, may be used as guard ports to receive filtrate therein that may be undesirable for sampling.

Furthermore, a tool, a system, and a method in accordance with the present disclosure may enable one or more ports, gauges, and/or sensors to observe and measure characteristics of the wellbore and reservoir. For example, one or more ports may be used to receive fluid therein or dispatch fluid therefrom. During this process, one or more gauges, one or more sensors, and/or one or more other ports may be used to observe characteristics of the wellbore and the reservoir, such as increases and/or decreases of fluid flow in areas of the reservoir affected by the fluid moving through the ports of the tool. Accordingly, the present disclosure contemplates a tool that may have a variety of functions and uses without departing from the scope of the present disclosure.

Although the present invention has been described with respect to specific details, it is not intended that such details should be regarded as limitations on the scope of the invention, except to the extent that they are included in the accompanying claims.

What is claimed is:

1. A tool to be used within a wellbore including a wall, the wellbore extending through a formation including formation fluid, the tool comprising:

a first packer including a packer port to enable formation fluid flow through the first packer, wherein the packer port abuts the wellbore wall when the first packer is expanded;

a second packer spaced from the first packer;

the first packer and the second packer being expandable to abut the wellbore wall to form an interval within the wellbore between the first packer and the second packer; and an interval port in fluid communication with the interval.

2. The tool of claim 1, further comprising:

a mandrel extending between the first packer and the second packer, the mandrel including the interval port to enable formation fluid flow through the mandrel.

3. The tool of claim 1, wherein the second packer includes a second packer port to enable formation fluid flow through the second packer.

4. The tool of claim 1, further comprising:

a third packer spaced from the first packer and expandable to abut the wellbore wall to form a second interval within the wellbore; and a second interval port in fluid communication with the second interval.

5. The tool of claim 4, further comprising:

a mandrel extending between the first packer and the third packer, the mandrel including the second interval port to enable formation fluid flow through the mandrel.

6. The tool of claim 4, wherein the third packer includes a third packer port to enable formation fluid flow through the third packer.

7. The tool of claim 1, further comprising:

a flow path formed through the tool;

wherein the packer port and the interval port are in fluid communication with the flow path.

8. The tool of claim 7, wherein the flow path comprises a packer flow path and an interval flow path, wherein the packer port is in fluid communication with the packer flow path, and wherein the interval port is in fluid communication with the interval flow path.

9. The tool of claim 8, wherein the packer flow path and the interval flow path are in selective fluid communication with each other.

10. The tool of claim 1, further comprising one of:

a packer port valve to selectively enable formation fluid flow through the packer port; and an interval port valve to selectively enable formation fluid flow through the interval port.

11. The tool of claim 1, further comprising one of:

a pressure gauge to measure pressure of formation fluid flowing through at least one of the packer port and the interval port; and a sensor positioned on the first packer to measure a property of the formation fluid.

12. A method of accessing formation fluid within a wellbore including a wall, the method comprising:

forming an interval within the wellbore by expanding a first packer and a second packer of a tool to abut the wellbore wall, the tool comprising a packer port on at least one of the first packer or the second packer and an interval port, wherein the packer port abuts the wellbore wall when the packer is expanded;

changing a state of one of the packer port and the interval port of the tool;

measuring a change in pressure of fluid flow received into the tool based upon the change of state of the one of the packer port and the interval port of the tool; and determining whether to change the state of the one of the packer port and the interval port of the tool based upon the measured change in pressure of fluid flow received in the tool.

13. The method of claim 12, wherein changing the state comprises:

enabling fluid flow through the one of the packer port and the interval port.

14. The method of claim 13, wherein determining whether to change the state comprises:

enabling fluid flow through the one of the packer port and the interval port of the tool if the measured change in pressure of fluid flow received in the tool is at or above a predetermined amount; and preventing fluid flow through the one of the packer port and the interval port of the tool if the measured change in pressure of fluid flow received in the tool is below the predetermined amount.

15. The method of claim 12, wherein changing the state comprises:

preventing fluid flow through the one of the packer port and the interval port.

16. The method of claim 15, wherein determining whether to change the state comprises:

enabling fluid flow through the one of the packer port and the interval port of the tool if the measured change in pressure of fluid flow received in the tool is at or above a predetermined amount; and preventing fluid flow through the one of the packer port and the interval port of the tool if the measured change in pressure of fluid flow received in the tool is below the predetermined amount.

17. The method of claim 12, further comprising:

changing a state of the other of the packer port and the interval port of the tool;

measuring a change in pressure of fluid flow received into the tool based upon the change of state of the other of the packer port and the interval port of the tool; and determining whether to change the state of the other of the packer port and the interval port of the tool based upon the measured change in pressure of fluid flow received in the tool.

18. The method of claim 12, wherein the packer port comprises a plurality of packer ports and the interval port comprises a plurality of interval ports, the method further comprising:

changing a state of the plurality of packer ports;

measuring a change in pressure of fluid flow received into the tool based upon the change of state of the plurality of packer ports;

determining whether to change the state of the plurality of packer ports of the tool based upon the measured change in pressure of fluid flow received in the tool;

changing a state of the plurality of interval ports;

measuring a change in pressure of fluid flow received into the tool based upon the change of state of the plurality of interval ports;

determining whether to change the state of the plurality of interval ports of the tool based upon the measured change in pressure of fluid flow received in the tool.

19. A system to access formation fluid within a wellbore including a wall, the wellbore extending through a formation including formation fluid, the system comprising:

a first expandable packer including a packer port positioned upon the first expandable packer, wherein the packer port is in fluid communication with a flow path of the tool and the packer port abuts the wellbore wall when the first packer is expanded;

a second expandable packer spaced from the first expandable packer;

a mandrel extending between the first expandable packer and the second expandable packer, the mandrel including an interval port in fluid communication with the flow path of the tool;

a valve operably coupled to the flow path to selectively enable fluid flow through one of the packer port and the interval port;

a pressure gauge operably coupled to the flow path to measure pressure of fluid flow through one of the packer port and the interval port; and a controller to control an operation of the valve based on a measured pressure of fluid flow through one of the packer port and the interval port from the pressure gauge.

20. The system of claim 19, wherein:

the flow path comprises a packer flow path and an interval flow path;

the valve comprises a packer valve and an interval valve;

the packer port is in fluid communication with the packer flow path;

the packer valve is operably coupled to the packer flow path to selectively enable formation fluid flow through the packer port;

the interval port is in fluid communication with the interval flow path; and the interval valve is operably coupled to the interval flow path to selectively enable formation fluid flow through the interval port.

* * * * *